United States Patent [19]

Paterson

[11] Patent Number: 4,551,091

[45] Date of Patent: Nov. 5, 1985

[54] METHOD FOR REDUCING THE VOLUME OF ATMOSPHERE NEEDED TO INHIBIT INGRESS OF AMBIENT OXYGEN INTO THE FURNACE CHAMBER OF A CONTINUOUS HEAT TREATMENT FURNACE

[75] Inventor: Alan J. F. Paterson, Crewe, England

[73] Assignee: Air Products and Chemicals, Inc., Allentown, Pa.

[21] Appl. No.: 605,318

[22] Filed: Apr. 30, 1984

[30] Foreign Application Priority Data

May 4, 1983 [GB] United Kingdom ..... 8312167

[51] Int. Cl.[4] ..... F27B 9/04; F27B 5/04; F27D 7/00

[52] U.S. Cl. ..... 432/23; 432/64; 432/198

[58] Field of Search ..... 432/64, 23, 198

[56] References Cited

U.S. PATENT DOCUMENTS 1,725,059 8/1929 Colby ..... 432/64
1,851,831 3/1932 Hayes ..... 432/23
2,253,897 8/1941 Doderer ..... 432/64
3,575,398 4/1971 Lincoln et al. ..... 432/64

*Primary Examiner*—John J. Camby
*Attorney, Agent, or Firm*—James C. Simmons; E. Eugene Innis

[57] ABSTRACT

The volume of atmosphere needed to inhibit the ingress of ambient oxygen into the furnace chamber (3) of a continuous heat treatment furnace (1) can be reduced by introducing a gas containing free oxygen (e.g. air) into the entrance section (2) and/or exit section (4) adjacent the roof thereof. Thus a relatively inexpensive gas may often be used in combination with an expensive atmosphere thereby significantly reducing overall process cost. Continuous heat treatment furnaces can readily be converted to perform the method by simply inserting adjacent the roof of the entrance and/or exit section a tube (3) having a slot and/or a plurality of downwardly facing holes (9) and connecting the tube to a supply of the requisite gas. The invention is applicable to both double open ended furnaces and continuous furnaces in which the exit section is filled with a liquid, e.g. oil or molten salt. In these latter cases the gas is introduced in the entrance section (2).

4 Claims, 13 Drawing Figures

METHOD FOR REDUCING THE VOLUME OF ATMOSPHERE NEEDED TO INHIBIT INGRESS OF AMBIENT OXYGEN INTO THE FURNACE CHAMBER OF A CONTINUOUS HEAT TREATMENT FURNACE

This invention relates to a method for reducing the volume of atmosphere needed to inhibit ingress of ambient oxygen into a continuous heat treatment furnace. As used herein the term "atmosphere" refers to a gas or gas mixture which contains less than 1000 ppm (by volume) free oxygen.

FIG. 1 of the accompanying drawings shows a simplified vertical cross-section through a double open ended continuous heat treatment furnace generally identified by reference numeral 1. The heat treatment furnace 1 comprises an entrance section 2, a furnace chamber 3, and an exit section 4. In use, articles are sequentially carried through the entrance section 2, the furnace chamber 3, and the exit section 4 on a conveyor system (not shown).

The furnace chamber 3 is provided with a heat source 5. A pipe 6 introduces the desired atmosphere into the furnace chamber 3. The composition of the atmosphere depends on the treatment being carried out in the furnace chamber 3 and can be, for example, endothermic gas, exothermic gas, nitrogen or nitrogen and hydrogen.

Common to most heat treatment processes is the need to inhibit ambient oxygen entering the furnace chamber 3 and, in practice, the flow of atmosphere through pipe 6 is determined by the flow necessary to reduce the ingress of air into the furnace chamber 3 to an acceptable level.

In order to inhibit the ingress of air into the furnace chamber it has been proposed to provide the entrance section and the exit section with nitrogen curtains. Whilst this expedient is generally satisfactory it is expensive.

We have found that, under favourable conditions, a simple air curtain can very effectively inhibit the ingress of air whilst at the same time allow the flow rate of atmosphere to the furnace chamber to be reduced.

According to the present invention there is provided a method for reducing the volume of atmosphere needed to inhibit ingress of ambient oxygen into the furnace chamber of a continuous heat treatment furnace having an entrance section, a furnace chamber, and an exit section, which method comprises the step of introducing an atmosphere containing less than 1000 ppm of free oxygen into the furnace chamber, characterized in that said method further comprises the step of introducing into the upper portion of the entrance section and/or exit section a stream of gas containing free oxygen; and/or passing a stream of gas containing free oxygen across the mouth of said entrance section and/or exit section.

Preferably, the gas is introduced in a downwards direction.

Advantageously, the gas is air. However, other gas containing from 5% to 30% by volume oxygen and preferably from 10% to 21% by volume may also be used.

Preferably, the gas is introduced at or near the entrance of the entrance section and/or the exit of the exit section.

It should be appreciated that the present invention is applicable to both double open ended continuous heat treatment furnaces and continuous heat treatment furnaces in which the exit section is filled with a liquid, for example an oil quench furnace or a hot salt quench furnace. In such heat treatment furnaces the gas would be introduced into the entrance section.

The flow of gas will normally be determined by trial and error. However, it should be sufficient to inhibit ambient air penetrating the furnace chamber and yet not so great as to contaminate the atmosphere itself.

For a better understanding of the present invention reference will now be made, by way of example, to FIGS. 1 to 12 of the accompanying drawings, in which.

Figure 1:
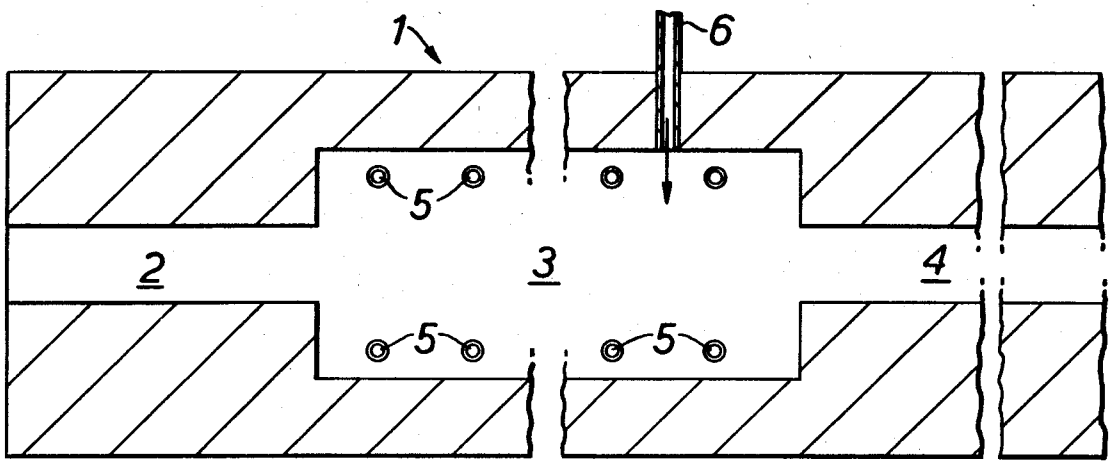
FIG. 1 is a vertical cross-section through a double open ended continuous heat treatment furnace.
Figure 2:
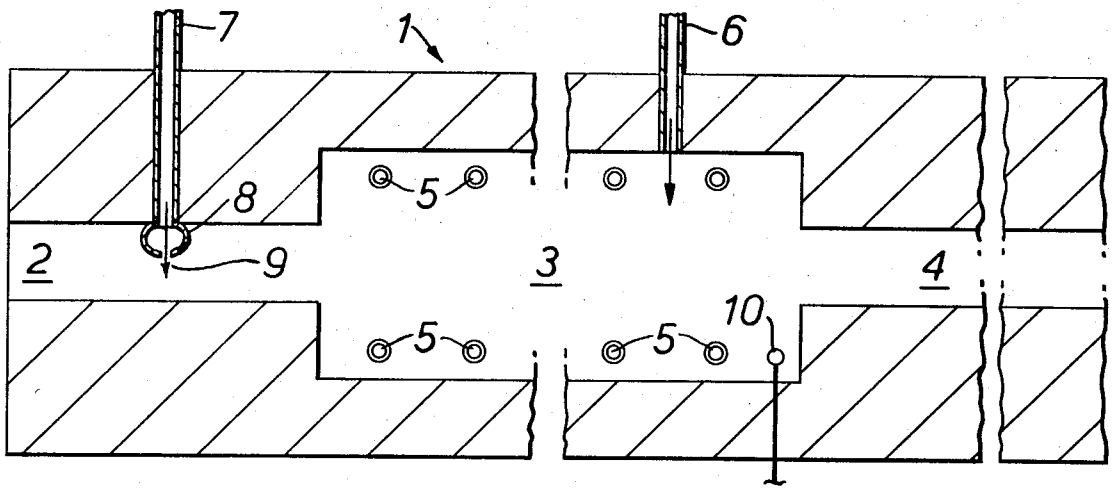
FIG. 2 is a simplified vertical cross-section through one embodiment of a continuous heat treatment furnace in accordance with the invention.

Referring to FIG. 2, the apparatus shown is generally similar to that shown in FIG. 1 except that the entrance section 2 is provided with a pipe 7 connected to a diffuser 8 which extends across the width of the entrance section 2 and has a line of openings 9 facing downwardly.

In an initial test the furnace chamber was heated to 740° C. Nitrogen was then introduced through pipe 6 and the flow adjusted until the oxygen level at probe 10 was 0.5% (by volume). Air was then introduced into pipe 7 and it was found that the flow of nitrogen through pipe 6 could be substantially reduced before the oxygen level at probe 10 returned to 0.5% (by volume).

Figure 3:
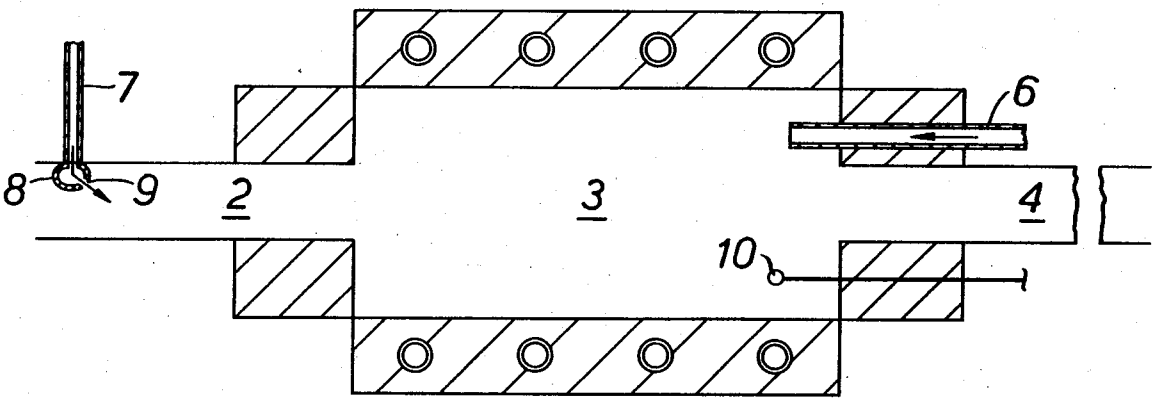
FIG. 3 is a simplified vertical cross-section through our first laboratory test apparatus.

Following this observation the laboratory apparatus shown in FIG. 3 was constructed. The apparatus comprises a 600 mm long muffle furnace surrounding a 75 mm internal diameter pipe simulating the furnace chamber 3. Entrance and exit sections 2 and 3 were formed by 25 mm internal diameter tubes mounted in either end of the 75 mm pipe as shown. The entrance and exit sections were each 0.5 meters long. The diffuser 8 was mounted 7 mm from the entrance to entrance section 2 and comprised a 5 mm overall diameter copper tube having seven 1.5 mm diameter holes along an 18 mm length. the diffuser 8 could be rotated to direct air as desired.

For the first series of tests exit section 4 was blanked off to simulate the oil in the exit section of an oil quench furnace and the furnace chamber 3 brought to temperature (740° C.). Various flowrates of nitrogen were then introduced into the furnace chamber 3 through pipe 6 and the equilibrium oxygen concentration measured at probe 10. The results are shown in FIG. 4 where the oxygen level (volume %) at probe 10 is plotted against the flow of nitrogen per square meter of cross-sectional area of entrance section 2.

A given air flow was then admitted through diffuser 8 and the concentration of oxygen at probe 10 measured for different flow rates of nitrogen. The process was then repeated with different air flows. The results of these tests, which were carried out with openings 9 facing vertically downwards, are shown in FIG. 5.

Figure 4:
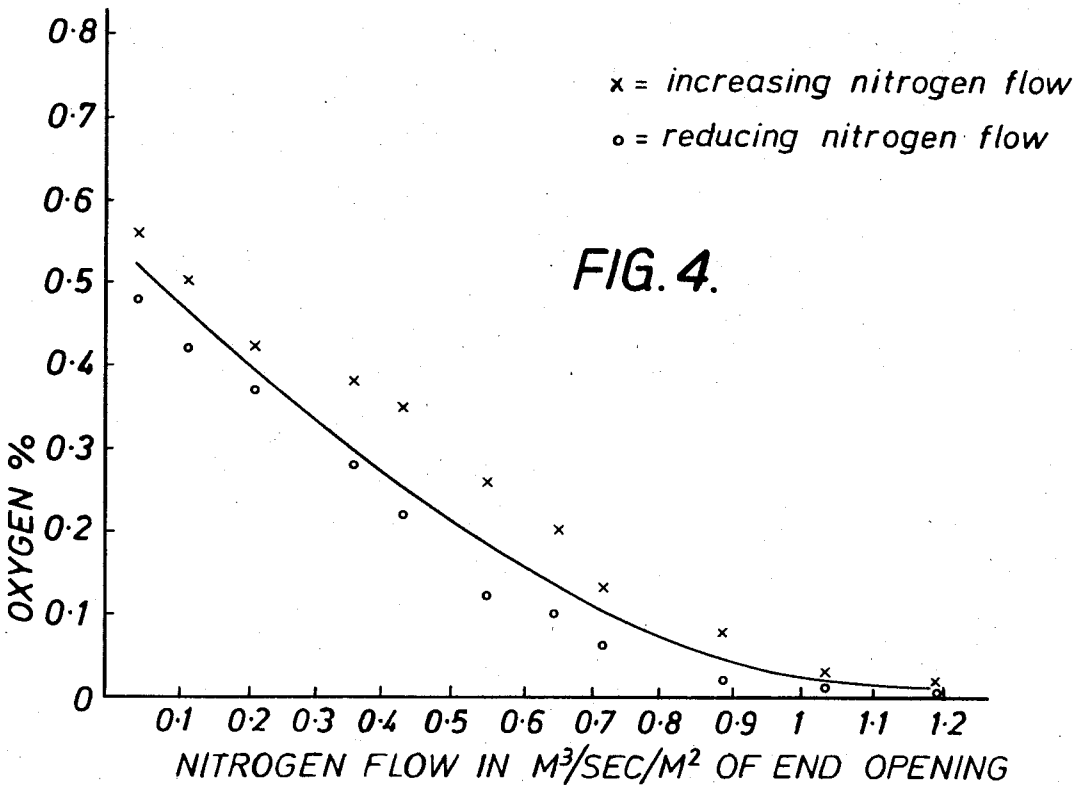
FIG. 4 is a graph showing the flow of nitrogen to the furnace chamber necessary to obtain given oxygen concentrations at a point in the laboratory test apparatus shown in FIG. 3.
Figure 5:
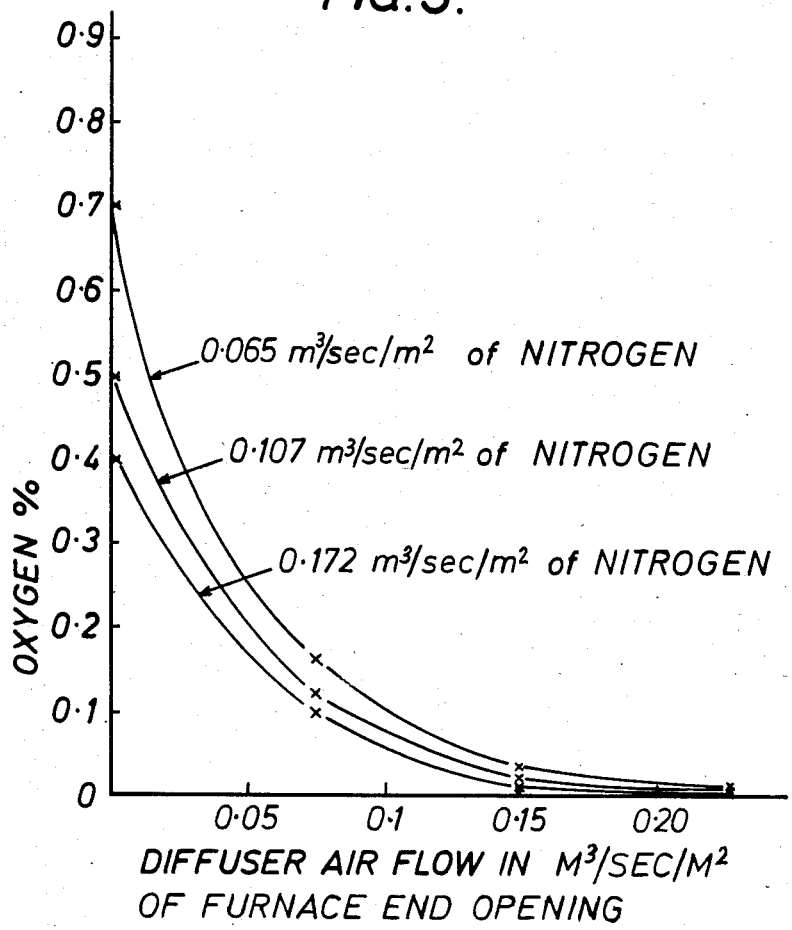
FIG. 5 is a graph showing flows of nitrogen to the furnace chamber and air to the entrance section which will achieve a given oxygen concentration at the same point in the laboratory test apparatus shown in FIG. 3.

Comparing FIGS. 4 and 5 it will be seen that an oxygen level of 0.3% by volume could be achieved by, for example:

(i) a nitrogen flow of 0.35 $m^3/sec/m^2$ through pipe 6

(ii) a nitrogen flow of 0.172 $m^3/sec/m^2$ through pipe 6+ an air flow of 0.021 $m^3/sec/m^2$ through diffuser 8 (Total: 0.193 $m^3/sec/m^2$)

(iii) a nitrogen flow of 0.107 $m^3/sec/m^2$ through pipe 6+ an air flow of 0.03 $m^3/sec/m^2$ through diffuser 8 (Total: 0.137 $m^3/sec/m^2$)

(iv) a nitrogen flow of 0.065 $m^3/sec/m^2$ through pipe 6+ an air flow of 0.039 $m^3/sec/m^2$ through diffuser 8 (Total: 0.104 $m^3/sec/m^2$)

(It should be noted that in commercial practice small natural gas or propane additions are conventionally made to furnace chambers to react with the 0.4%–0.5% (by volume) oxygen which would otherwise be present.)

The most surprising factor is that the total volume of gas, i.e. nitrogen plus air for a given oxygen concentration is less than the volume of nitrogen alone. It will however be noted that very low oxygen concentrations are very easily obtainable. Thus, an oxygen concentration of 0.05%, previously only obtainable with a nitrogen flow to pipe 6 of 0.89 $m^3/sec/m^2$ could also be obtained with 0.065 $m^3/sec/m^2$ of nitrogen to pipe 6 and an air flow of 0.136 $m^3/sec/m^2$ to diffuser 8, (a total flow rate of 0.201 $m^3/sec/m^2$).

Tests have shown that the holes 9 may, with advantage, be inclined towards or away from the furnace chamber 3 and whilst experiments are currently being carried out to confirm initial observations it is anticipated that the holes 9 should be orientated between 0° and 40° from the vertically downwards position with 0° to 20° being preferred. The effect of the air could also be obtained by turning the diffuser so that the air bounced off the roof of the entrance section 2. A similar effect could also be achieved by introducing the air horizontally through the side of the entrance section 2 adjacent the roof thereof.

In a further test using the apparatus shown in FIG. 3, (with exit section 4 blanked off), it was found that with only 0.06 $m^3/sec/m^2$ nitrogen injected through pipe 6 and air being introduced through diffuser 8 oxygen levels of 100 to 200 ppm could be achieved at probe 10 without difficulty. The flow of nitrogen alone through pipe 6 necessary to achieve such low levels was approximately 1.2 $m^3/sec/m^2$ For the second series of tests the entrance section 2 was replaced by a 0.75 m length of pipe having a square cross-section of sides 69 mm. The diffuser 8 was also replaced by a 9.5 mm o/d tube with 40×1.6 mm diameter holes arranged in two parallel rows.

Figure 6:
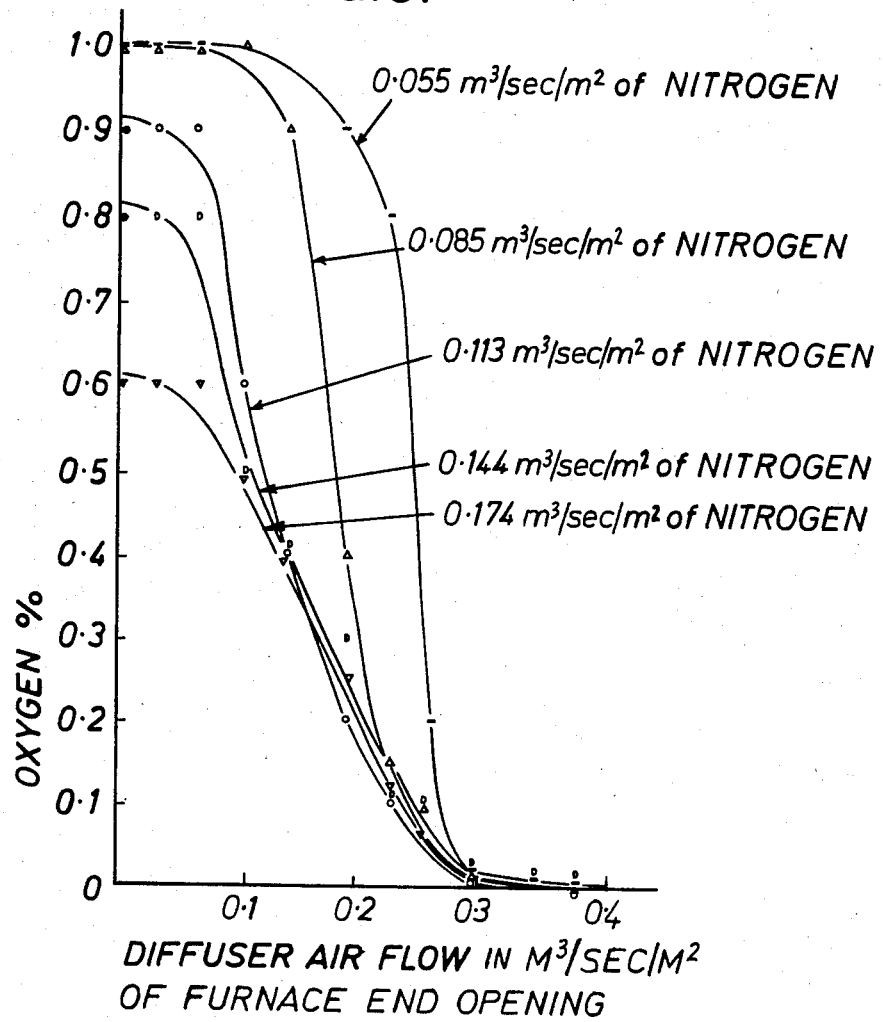
FIG. 6 is a graph similar to that shown in FIG. 5, but resulting from a different entrance section.

The procedure described with reference to FIG. 5 was then repeated except that the furnace chamber 3 was only heated to 700° C. The results are shown in FIG. 6. Again, the ease with which the oxygen level could be reduced below 0.01% will be noted. In this embodiment it was found that inclining the diffuser so that the air was directed towards the furnace chamber had little beneficial effect. Furthermore, it was noted that moving the diffuser further towards the furnace chamber 3 inside the entrance section showed very little improvement.

Figure 7:
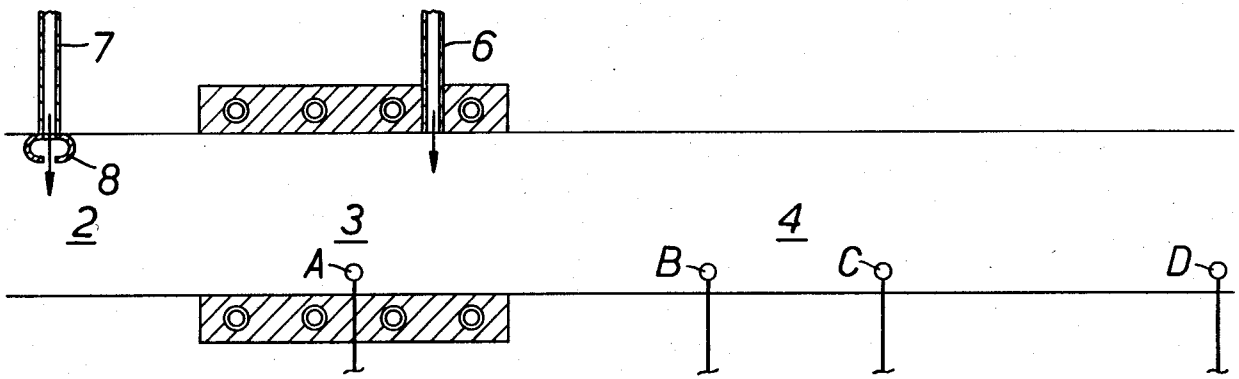
FIG. 7 shows a second laboratory test apparatus.

FIG. 7 shows our second test apparatus which simulated a double open ended furnace, e.g. for brazing, sintering, annealing or general heat treatment. The apparatus used the entrance section referred to with reference to FIG. 3 together with an exit section 4 comprising 4.4 m of 75 mm internal diameter pipe. Oxygen probes A, B, C, and D were placed 5.25 m, 3 m, 2 m and 15 cm respectively from the outlet of exit section 4.

Figure 8:
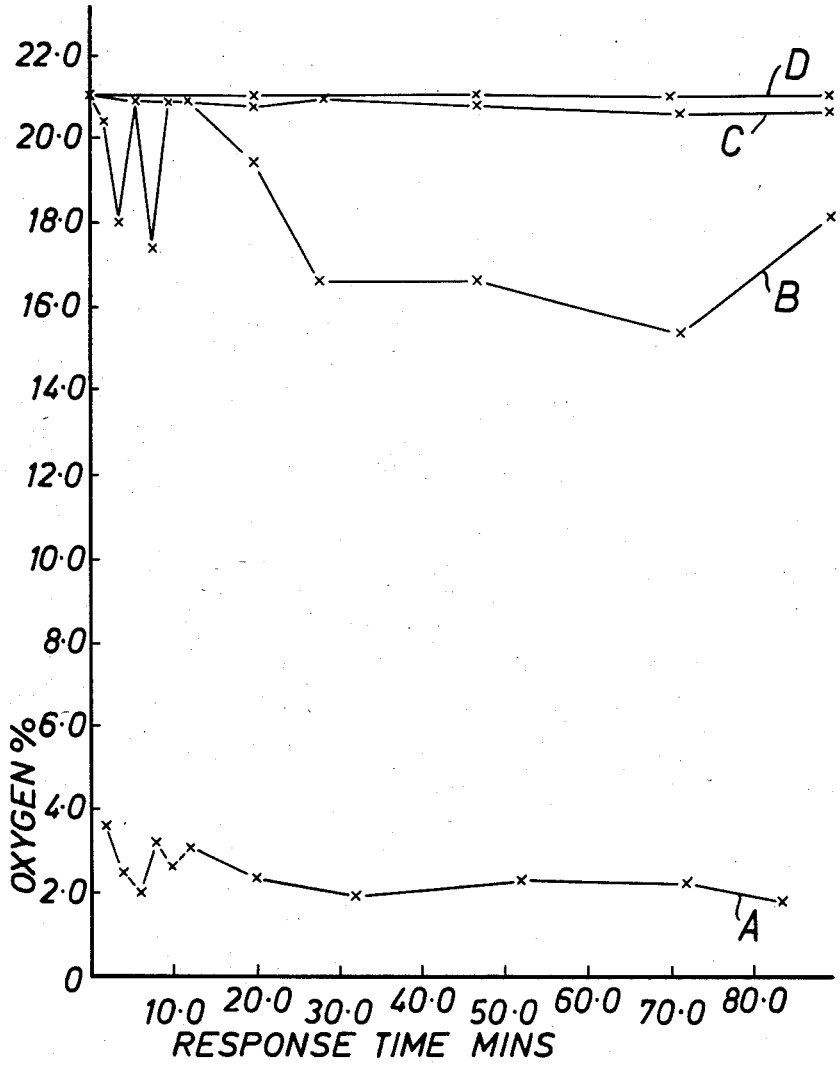
FIG. 8 is a graph showing the variation with time of the oxygen levels at the points A, B, C and D in the laboratory test apparatus shown in FIG. 7 with a fixed flow of nitrogen to the furnace chamber.

After heating the furnace chamber to 700° C., 1.5 $m^3/hr$ of nitrogen was introduced into the furnace chamber and the oxygen level at probes A, B, C and D recorded over a period of 80 minutes. The results are shown in FIG. 8.

Figure 9:
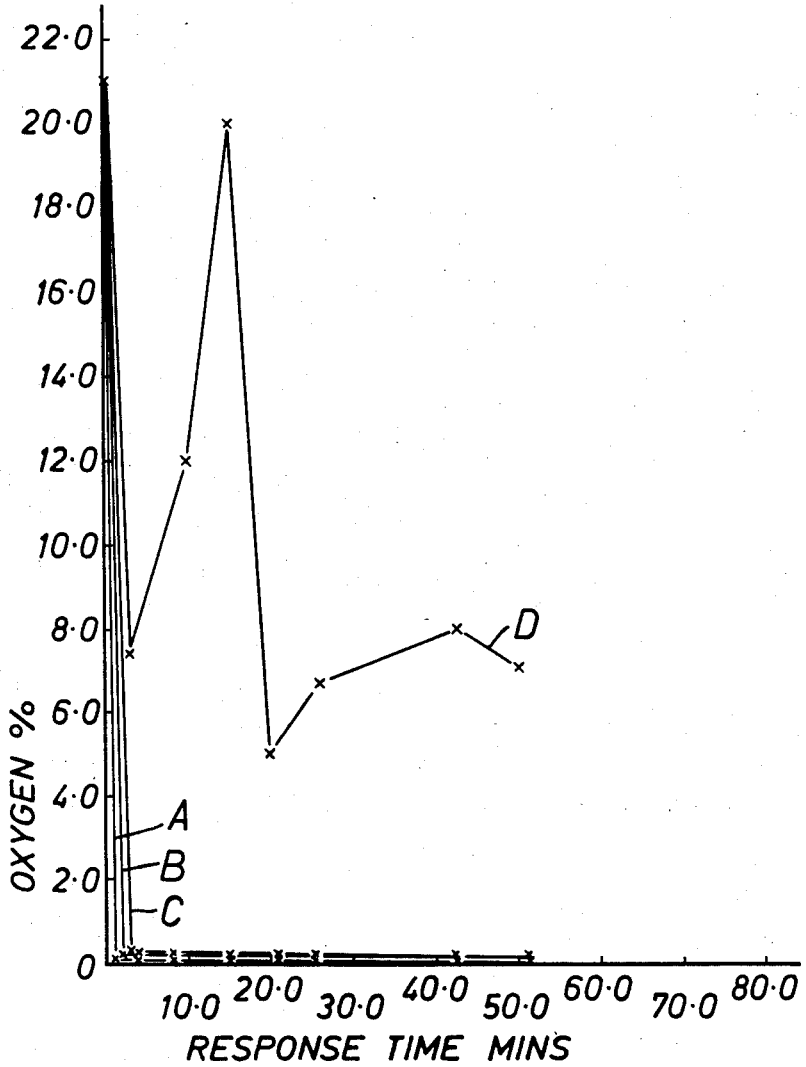
FIG. 9 is a graph similar to FIG. 8 but showing the effect of simultaneously introducing nitrogen to the furnace chamber and air through a diffuser in the exit section of the apparatus.

The supply of nitrogen was then terminated and, after a break of 4 hours, was resumed together with 1.2 $m^3/hr$ of air to the diffuser 8 mounted adjacent the top of exit section 4. The oxygen level at probes A, B, C and D were recorded over a period of 80 minutes and the results are shown in FIG. 9. It will be seen that the oxygen level at probes A, B and C dropped very rapidly and remained low thereafter. After 25 minutes, the oxygen probe A recorded a steady level of 0.08% oxygen.

Figure 10:
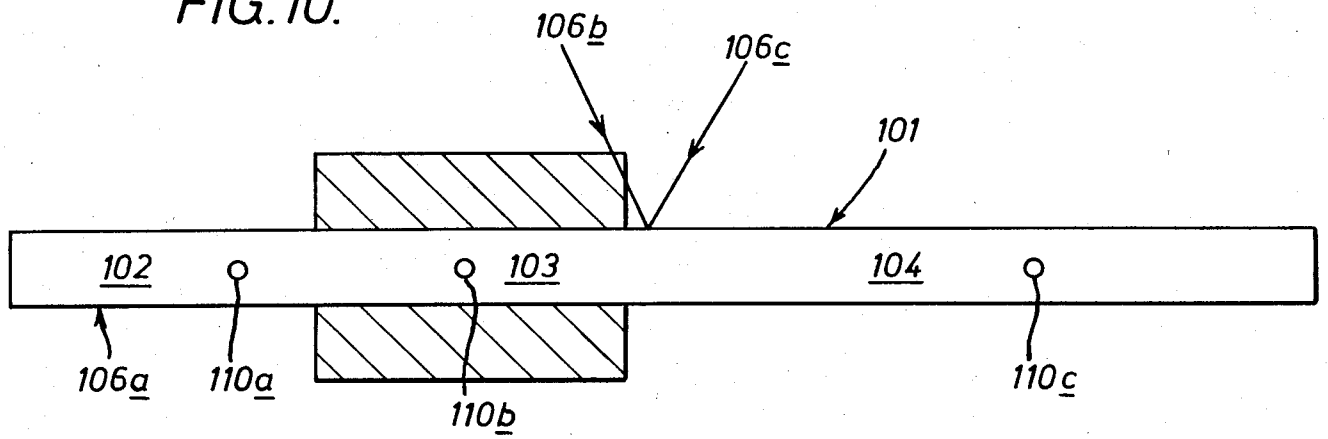
FIG. 10 is a schematic vertical cross-section through a full scale continuous heat treatment furnace.

For the third and final series of tests a production continuous heat treatment furnace was used which is schematically shown in FIG. 10. The furnace 101 was 11 meters long and included a tunnel 300 mm wide and 90 mm high through which parts to be heat treated were carried on a mesh conveyor belt 120. Two types of diffuser were used in these tests and are shown in FIGS. 11 and 12.

Figure 11:
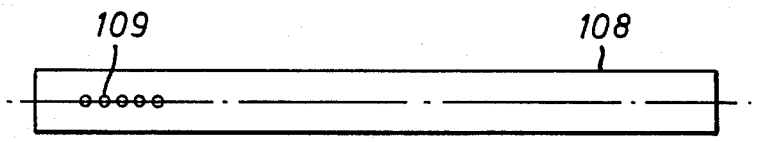
FIG. 11 is a bottom plan view of one embodiment of a diffuser used in the continuous heat treatment furnace shown in FIG. 10.

The diffuser 108 shown in FIG. 11 was 400 mm long and 17 mm in diameter. It contained forty five 3 mm diameter holes 109 equally spaced over the centre 330 mm of the diffuser 108.

Figure 12:
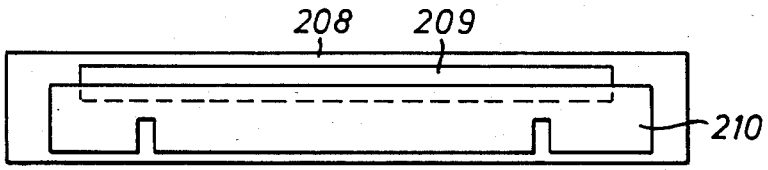
FIG. 12 is a bottom plan view of another embodiment of a diffuser used in the continuous heat treatment furnace shown in FIG. 10.
Figure 13:
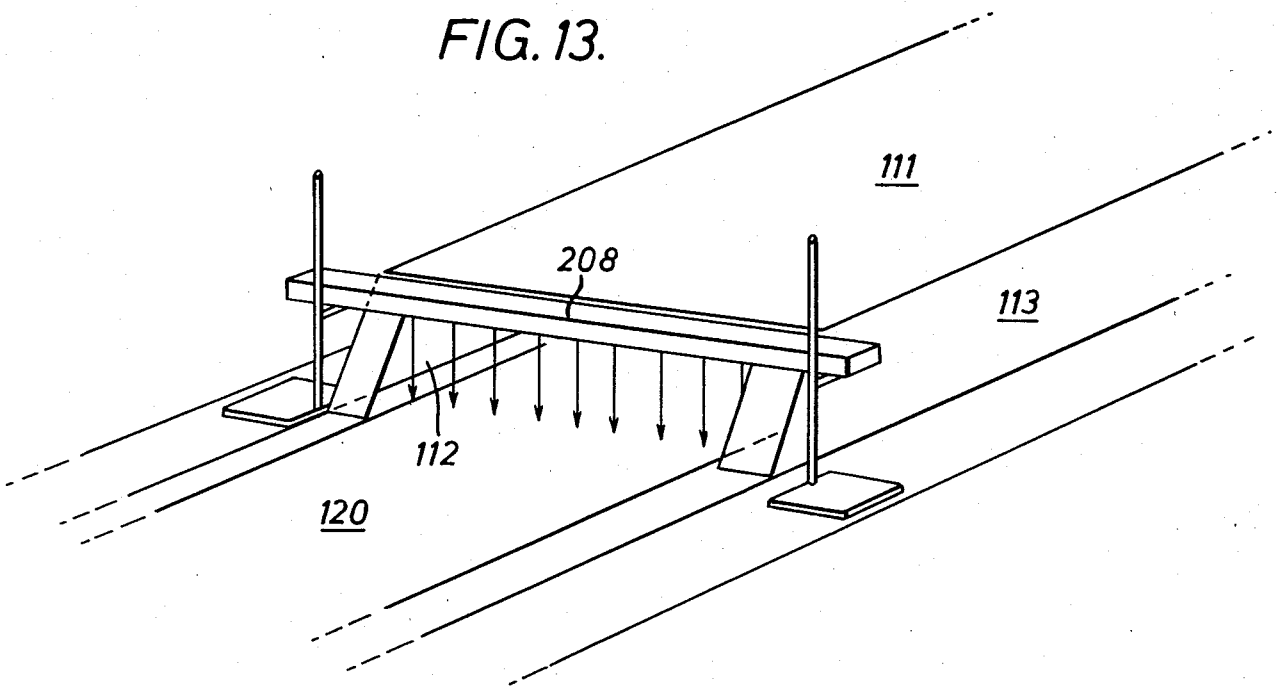
FIG. 13 is a detailed view showing the diffuser of FIG. 11 in position on the continuous heat treatment furnace shown in FIG. 10.

The diffuser 208 shown in FIG. 12 was also 400 mm long and was formed from hollow square section stock of 44 mm×44 mm overall cross-section. A slot 209 was cut in one side of the stock and extended over the centre 330 mm of the diffuser 208. The width of the slot 209 could be varied by a movable plate 210.

In use, either diffuser was mounted adjacent the entrance and/or exit sections such that it was outside but contiguous with the roof 111 of the sections as shown in FIG. 12. The outer ends of the side walls 112 and 113 of the entrance and exit sections were inclined in such a manner that the air from the diffusers, when directed vertically downwards, was within the entrance and/or exit sections.

Unlike the laboratory furnace used in the second series of tests the natural draught in the production heat treatment furnace 100 was towards the exit section 104.

In order to simulate normal operating conditions, the furnace chamber 103 was heated to 800° C. and nitrogen was introduced through inlet pipes 106*a*, 106*b* and 106*c* mounted 0.2 m, 6.9 m and 6.9 m respectively from the entrance of entrance section 102. Inlets 106*b* and 106*c* were inclined as indicated.

Oxygen sensors 110*a*, 110*b* and 110*c* were mounted 1 m, 5.4 m and 9.1 m from the entrance of entrance section 102. 10.9 $m^3$/hr nitrogen and 12.3 $m^3$/hr nitrogen were applied to inlet pipes 106*b* and 106*c* respectively and the oxygen concentration at sensors 110*a*, 110*b* and 110*c* was measured for various flows of nitrogen through inlet pipe 106*a*. The results are tabulated in Tests 1, 2 and 3 of Table 1.

After several preliminary tests with the diffusers it became apparent that best results were obtained with a diffuser at both ends of the furnace 101.

cent the roof can be effective to form a blanket to inhibit the hot atmosphere from the furnace chamber rising.

Whilst the gas will normally be air it will be appreciated that other gas containing free oxygen could also be used. Typically such gas would contain (by volume) between 5% and 30% oxygen and, more typically, between 10% and 21% oxygen.

Whilst it is most strongly recommended that the gas should enter the entrance and/or exit section some small benefits may be obtained if the gas containing free oxygen is simply passed across the mouth of the entrance and/or exit sections.

Although not shown in the Figures, if the flow of air were increased beyond a certain limit the air rapidly contaminates the atmosphere in the furnace chamber. In the case of FIG. 6, contamination very rapidly increased once the diffuser air flow was increased beyond 0.48 $m^3/sec/m^2$.

Perhaps the most surprising feature disclosed is that the flow rate of atmosphere necessary to inhibit ingress of air into the furnace chamber can be reduced by the use of a stream of air itself.

TABLE 1

TEST RESULTS ON PRODUCTION FURNACE

| Test No. | Air Diffuser Type: Entrance Section | Air Diffuser Type: Exit Section | Air flow $m^3$/hr: Entrance Section | Air flow $m^3$/hr: Exit Section | Nitrogen flow $m^3$/hr: 106a | Nitrogen flow $m^3$/hr: 106b | Nitrogen flow $m^3$/hr: 106c | Oxygen level % v/v: 110a | Oxygen level % v/v: 110b | Oxygen level % v/v: 110c |
|---|---|---|---|---|---|---|---|---|---|---|
| 1 | — | — | — | — | 22 | 10.9 | 12.3 | 1.5 | 0.06 | 0.2 |
| 2 | — | — | — | — | 10.9 | 10.9 | 12.3 | 2.0 | 0.1 | 0.5 |
| 3 | — | — | — | — | — | 10.9 | 12.3 | 21.0 | 0.1 | 0.5 |
| 4 | holes 3 mm 0 | slot 18 mm wide | 8.5 | 40.6 | 44 | 10.9 | 12.3 | 0.4 | 0.1 | 0.8 |
| 5 | holes 3 mm 0 | holes 3 mm 0 | 8.5 | 20.3 | — | 10.9 | 12.3 | 1.0 | 0.08 | 0.4 |
| 6 | slot 1 mm wide | slot 1 mm wide | 9.8 | 20.3 | — | 10.9 | 12.3 | 0.5 | 0.06 | 0.3 |

Tests 4, 5 and 6 of Table 1 show how the amount of nitrogen (i.e. furnace atmosphere) needed can be reduced by blowing air through the diffusers at either end of the furnace 100. It will be noted from Test 6 that the diffuser shown in FIG. 12 was particularly effective.

The table shows that in order to save a given volume of atmosphere it is necessary to pass a somewhat larger volume of gas through the diffusers. Accordingly, commercial benefit is derived when the cost of providing the gas is less than the cost of providing the atmosphere.

As indicated above only small advantages were obtained by moving the diffuser to direct the gas flow at an angle to the vertical and, for converting existing continuous furnace, we believe that it will be expedient to position the diffuser(s) adjacent the inlet of the entrance section or adjacent the outlet of the exit section.

Various modifications to the apparatus described are envisaged, for example a diffuser could be formed by a plurality of holes in the roof of the entrance and/or exit sections. Alternatively, or in addition, the gas could conceivably be introduced through the upper portion of the sides of the entrance and/or exit section. Whilst the gas would preferably be delivered through downwardly inclined channels in the sides, it is noted that horizontal, or even upward, introduction of gas adja-

I claim:

1. A method for reducing the volume of atmosphere needed to inhibit ingress of ambient oxygen into the furnace chamber of a continuous heat treatment furnace having an entrance section, a furnace chamber, and an exit section, which method comprises the step of introducing an atmosphere containing less than 1,000 ppm of free oxygen into the furnace chamber to establish a working atmosphere within the furnace chamber, characterized in that said method further comprises the step of introducing into the upper portion of the entrance section and/or exit section of the furnace chamber a stream of gas containing free oxygen; and/or passing a stream of gas containing free oxygen across the mouth of said entrance section and/or exit section of said furnace chamber; whereby said stream creates a dynamic pressure or momentum force which deflects the working atmosphere exiting the furnace in a downward direction.

2. A method according to claim 1, wherein the gas is introduced in a downwards direction.

3. A method according to claim 1, wherein said gas is air.

4. A method according to claim 2, wherein said gas is air.

* * * * *